US010545527B2

(12) United States Patent
Hallikainen

(10) Patent No.: US 10,545,527 B2
(45) Date of Patent: Jan. 28, 2020

(54) REFERENCE VOLTAGE GENERATOR

(71) Applicant: Nordic Semiconductor ASA, Trondheim (NO)

(72) Inventor: Samuli Hallikainen, Trondheim (NO)

(73) Assignee: Nordic Semiconductor ASA, Trondheim (NO)

( * ) Notice: Subject to any disclaimer, the term of this patent is extended or adjusted under 35 U.S.C. 154(b) by 0 days.

(21) Appl. No.: 16/465,992

(22) PCT Filed: Dec. 1, 2017

(86) PCT No.: PCT/GB2017/053628
§ 371 (c)(1),
(2) Date: May 31, 2019

(87) PCT Pub. No.: WO2018/100390
PCT Pub. Date: Jun. 7, 2018

(65) Prior Publication Data

US 2019/0302825 A1 Oct. 3, 2019

(30) Foreign Application Priority Data

Dec. 2, 2016 (GB) ..... 1620541.1

(51) Int. Cl.
*G05F 3/26* (2006.01)

(52) U.S. Cl.
CPC ..... *G05F 3/262* (2013.01)

(58) Field of Classification Search
CPC ... G05F 1/613; G05F 1/70; G05F 3/16; G05F 3/26; G05F 3/262; G05F 3/30;
(Continued)

(56) References Cited

U.S. PATENT DOCUMENTS 7,446,599 B1 * 11/2008 Wang ..... G05F 3/242 323/313
7,692,481 B2 * 4/2010 Roh ..... G05F 3/30 323/312

(Continued)

FOREIGN PATENT DOCUMENTS

GB 2442494 A 4/2008
JP 2003263322 A 9/2003

OTHER PUBLICATIONS

International Search Report and Written Opinion for PCT/GB2017/053628, dated Mar. 6, 2018, 13 pages.

(Continued)

*Primary Examiner* — Adolf D Berhane
(74) *Attorney, Agent, or Firm* — Klarquist Sparkman, LLP

(57) ABSTRACT

A reference voltage circuit 2 comprises: a bandgap circuit portion comprising first and second reference transistors (Q1, Q2) and a current source arranged to drive the first and second reference transistor at different current densities, wherein the first and second reference transistors are connected to first and second nodes (N1, N2) respectively; an operational transconductance amplifier (M4, M5, M10, M11, M12) arranged to produce an output current that is proportional to a difference between a voltage at the first node and a voltage at the second node; an output current mirror circuit portion (M3) arranged to generate a mirror current that is a scaled version of the output current and drive said mirror current through a load (R3) so as to produce a reference voltage ($V_{ref}$); and a reference monitoring circuit portion (6) arranged to monitor the operational transconductance amplifier and generate a flag ($V_{ready}$) if a current flowing through the operational transconductance amplifier exceeds a threshold.

25 Claims, 2 Drawing Sheets

Figure 1:
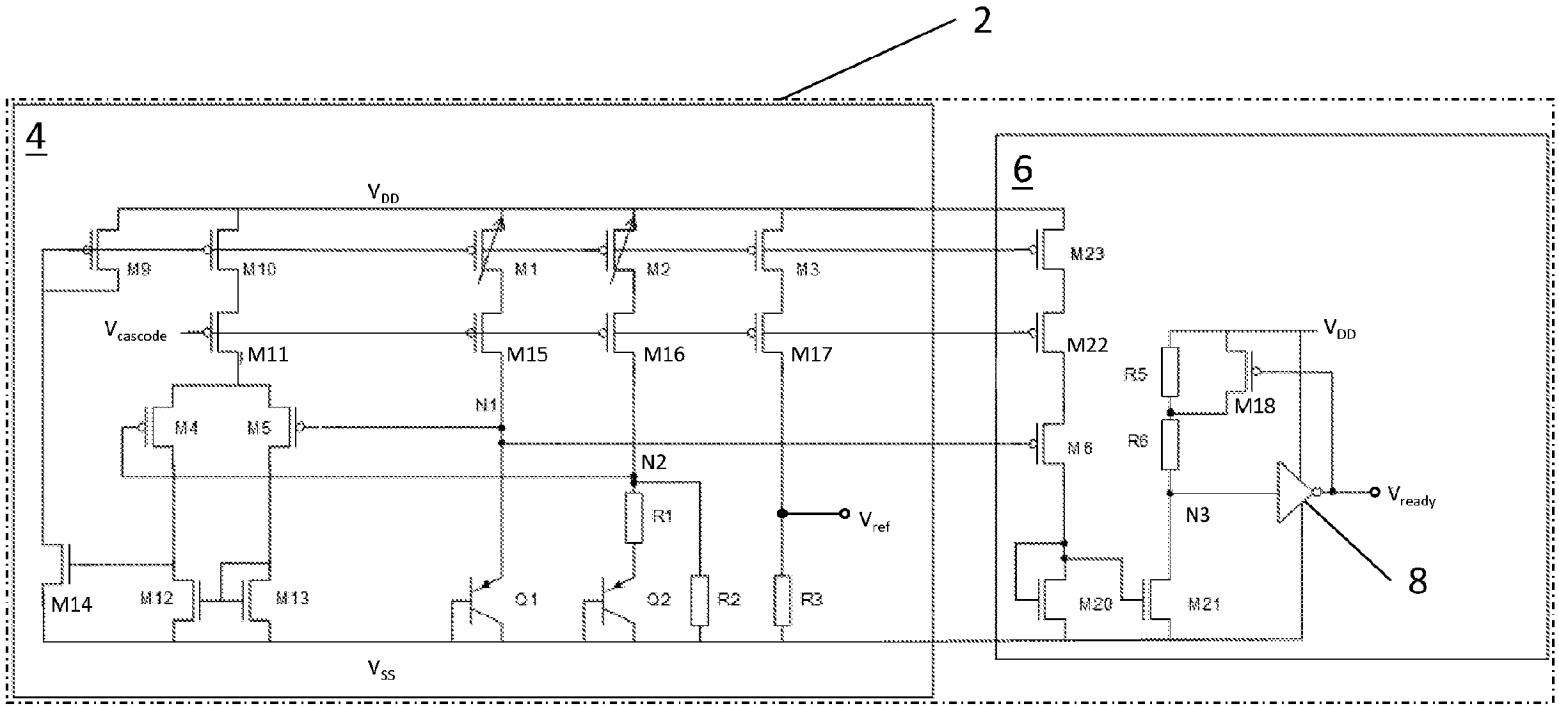

(58) Field of Classification Search
CPC ..... H02M 3/157; H02M 3/04; H02M 3/10; H02M 3/135
See application file for complete search history.

(56) References Cited

U.S. PATENT DOCUMENTS

| | | | | |
|---|---|---|---|---|
| 8,058,863 | B2 * | 11/2011 | Cho | G05F 3/30 323/315 |
| 2005/0093531 | A1 | 5/2005 | Vorenkamp et al. | |
| 2011/0309818 | A1 | 12/2011 | Sun | |
| 2013/0106390 | A1 * | 5/2013 | Wadhwa | G05F 3/30 323/313 |
| 2014/0091780 | A1 * | 4/2014 | Hu | G05F 1/462 323/314 |
| 2014/0224962 | A1 * | 8/2014 | Pahr | G05F 3/02 250/208.1 |

OTHER PUBLICATIONS

Search Report under Section 17(5) for GB1620541.1, dated Jun. 30, 2017, 3 pages.

* cited by examiner

REFERENCE VOLTAGE GENERATOR

CROSS REFERENCE TO RELATED APPLICATIONS

This is the U.S. National Stage of International Application No. PCT/GB2017/053628, filed Dec. 1, 2017, which was published in English under PCT Article 21(2), which in turn claims the benefit of Great Britain Application No. 1620541.1, filed Dec. 2, 2016.

The present invention relates to reference voltage generators, particularly to monitoring circuits that can ensure that a reference voltage generator is fully initialised and able to produce a reference voltage that can be relied upon by other electronic circuits and devices.

A reference voltage circuit is typically a key component within many electronic devices as it provides the reference value to which a measured value is compared, e.g. in voltage regulators which are control systems arranged to drive an output voltage (the measured value) to a desired set point (the reference value).

Conventional temperature-stable reference voltage circuits are usually constructed using bipolar junction transistors (BJTs), arranged to provide a bandgap reference circuit, so named for producing a 1.25 V output voltage, close to the voltage required for a charge carrier (i.e. an electron or a hole) to overcome the 1.22 eV bandgap associated with silicon at absolute zero. It will of course be appreciated that bandgap reference circuits may produce other reference voltages, for example 0.9 V, which may be suitable for use by other circuitry within the device. Such a bandgap reference circuit operates using a voltage difference between two p-n junctions operated at different current densities to produce an output voltage with low temperature dependence.

As reference voltages are heavily relied upon by various other circuits such as comparators, analogue-to-digital converters (ADCs), and supply voltage monitoring circuits (e.g. brown-out monitoring circuits), it is important to ensure that the reference voltage that is being provided by the reference voltage circuit is at the correct level and ready for use. Some reference voltage circuits are provided with a reference monitoring circuit that checks the level of the reference voltage being produced and produce a signal indicating whether or not the reference voltage is ready for use. Conventional reference monitoring circuits known in the art per se may typically include an operational transconductance amplifier (OTA) that produces an output current that is dependent on a differential voltage input. An ideal OTA possess a linear relationship between the differential input voltage and the output current, where there the constant factor relating the two quantities is referred to as the transconductance of the amplifier, $g_m$.

However, conventional reference monitoring circuits are typically complex and suffer accuracy issues. In particular, if the supply voltage drops (e.g. due to a malfunction), the headroom of the OTA may be reduced such that the reference monitoring circuit no longer functions as intended.

When viewed from a first aspect, the present invention provides a reference voltage circuit comprising:

a bandgap circuit portion comprising first and second reference transistors and a current source arranged to drive the first reference transistor at a first current density and to drive the second reference transistor at a second, different current density, wherein the first reference transistor is connected to a first node and the second reference transistor is connected to a second node;

an operational transconductance amplifier arranged to produce an output current that is proportional to a difference between a voltage at the first node and a voltage at the second node;

an output current mirror circuit portion arranged to generate a mirror current that is a scaled version of the output current and drive said mirror current through a load so as to produce a reference voltage; and a reference monitoring circuit portion arranged to monitor the operational transconductance amplifier and generate a flag if a current flowing through the operational transconductance amplifier exceeds a threshold.

Thus it will be appreciated by those skilled in the art that embodiments of the present invention provide a voltage regulation circuit that can provide a flag indicative of whether sufficient current is flowing through the operational transconductance amplifier, and thus whether the bandgap circuit portion may be relied upon for providing the reference voltage. The voltage regulation circuit of the present invention provides the flag with a defined, logical state regardless of any supply voltage variations as the threshold used by the reference monitoring circuit portion "tracks" the headroom requirements of the operational transconductance amplifier. In other words, as the reference monitoring circuit produces a flag when the current through the operational transconductance amplifier exceeds a threshold, the reference monitoring circuit is "blind" to the headroom requirements of the operational transconductance amplifier (the current is sufficient indication that it is operating as required, regardless of headroom requirements). This may prevent circuits that are dependent on the bandgap reference (e.g. a brown-out monitoring circuit) from malfunctioning due to problems with the supply causing false positive flags.

In some embodiments, the operational transconductance amplifier comprises first and second differential pair field-effect-transistors (FETs) arranged such that a gate terminal of the first differential pair field-effect-transistor is connected to the first node and a gate terminal of the second differential pair field-effect-transistor is connected to the second node. These first and second differential pair FETs form a differential pair, known in the art per se, that provides an output that depends on a difference between the voltages applied to the respective gate terminals of the first and second differential pair FETs.

In some embodiments, the operational transconductance amplifier (OTA) comprises first and second current mirror load field-effect-transistors, arranged such that: a drain terminal of the first current mirror load field-effect-transistor is connected to a drain terminal of the first differential pair field-effect-transistor; a drain terminal of the second current mirror load field-effect-transistor is connected to a drain terminal of the second differential pair field-effect-transistor; and respective gate terminals of the first and second current mirror load field-effect-transistors are connected to the drain terminal of the first current mirror load field-effect-transistor. This arrangement drives the differential amplifier of the OTA and to make the voltages at the first and second nodes equal, hence closing the bandgap loop. In a set of preferred embodiments, the first current mirror load field-effect-transistor is matched to the first replica current mirror field-effect-transistor.

In some further embodiments, the operational transconductance amplifier comprises a tail field-effect-transistor arranged such that a drain terminal thereof is connected to respective drain terminals of the first and second differential pair field-effect-transistors. In some such embodiments, a gate terminal of the tail field-effect-transistor is connected to the current mirror.

In some embodiments, the reference monitoring circuit portion comprises a second current mirror and a replica field-effect-transistor having a gate terminal thereof connected to the first node, wherein the second current mirror is arranged to generate a replica current that is a scaled version of the output current and drive said replica current through a first reference resistor so as to generate a voltage at a monitor node between the second current mirror and the first reference resistor. In a set of preferred embodiments, the replica field-effect transistor is matched to the first differential pair field-effect-transistor.

It will be understood that the term "matched" as used herein with reference to two transistors means that they are substantially identical, subject to any typical manufacturing tolerances and variations. For example, two matched transistors should be made from the same materials (e.g. metals, semiconductors and doping levels) and have the same geometry (e.g. channel length and width), such that they exhibit substantially the same electrical characteristics as one another. By having the replica FET and the first differential FET matched in this manner, the replica current will be the same current flowing through the "branch" of the operational transconductance amplifier that includes the first differential FET.

In some embodiments, the second current mirror comprises first and second replica current mirror field-effect-transistors, arranged such that: respective gate terminals of the first and second replica current mirror field-effect-transistors are connected to a drain terminal of the first replica current mirror field-effect-transistor and to a drain terminal of the replica field-effect-transistor; and a drain terminal of the second replica current mirror field-effect-transistor is connected to the monitor node.

While the voltage at the monitor node may be used as the flag itself, in preferred embodiments the reference monitoring circuit portion comprises a single-input logic gate having an input terminal thereof connected to the monitor node, wherein the logic gate is arranged to produce a first logic value at an output thereof if the voltage at the monitor node is above a first threshold and to produce a second logic value at the output if the voltage at the monitor node is below a second threshold. Thus, in accordance with such embodiments, the logic gate may produce a digital signal (i.e. a binary '0' or '1') that depends on the value of the voltage at the monitor node.

In some such embodiments, the logic gate comprises a Boolean inverter, wherein the first logic value is logic low and the second logic value is logic high. While such a Boolean may use a single threshold (i.e. the first and second thresholds are equal), in preferred embodiments a hysteresis arrangement is connected between the input and the output of the inverter and is arranged such that the first threshold is different to the second threshold. Such a hysteresis arrangement may, at least in some embodiments, comprise a second reference resistor and a switching arrangement, wherein said switching arrangement may selectively couple the first and second reference resistors. Thus it can be seen that the resistance connected to the monitor node can be varied between two different values in order to switch between the first and second threshold values.

In a set of such embodiments, the switching arrangement comprises a hysteresis transistor connected in parallel to the second reference resistor, wherein a gate terminal of said hysteresis transistor is connected to the output of the inverter. In such arrangements, the digital signal produced by the inverter is applied to the gate terminal of the hysteresis transistor which, depending on the value of the digital signal, will make drive the conductivity of the hysteresis transistor high, effectively providing a "bypass" for current by shorting the second reference resistor, or low, effectively disconnecting the hysteresis transistor and causing the resistances of the first and second resistors to simply add in series.

In some alternative embodiments, the logic gate comprises a Schmitt trigger, wherein the first logic value is logic high and the second logic value is logic low. Schmitt triggers convert an analogue input signal (i.e. the voltage at the monitor node) to a digital output signal and typically use positive feedback connected from the output of a comparator differential amplifier to the non-inverting input of the same so as to provide hysteresis.

The output current mirror circuit portion is arranged to take an output current produced by the operational transconductance amplifier and drive a scaled version of the replica current through the load so as to generate the reference voltage. In some embodiments, the output current mirror circuit portion comprises:

- an output field-effect-transistor arranged such that a gate terminal thereof is connected to an output of the operational transconductance amplifier;
- first and second output current mirror field-effect-transistors, arranged such that:
  - a drain terminal of the first output current mirror field-effect-transistor is connected to a drain terminal of the output field-effect-transistor;
  - a drain terminal of the second output current mirror field-effect-transistor is connected to the load; and
  - respective gate terminals of the first and second output current mirror field-effect-transistors are connected to the drain terminal of the first output current mirror field-effect-transistor.

In some preferred embodiments, the output current mirror circuit portion further comprises third and fourth output current mirror field-effect-transistors, arranged such that: respective gate terminals thereof are connected to the gate and drain terminals of the first output current mirror field-effect-transistor; a drain terminal of the third output current mirror field-effect-transistor is connected to the first node; and a drain terminal of the fourth output current mirror field-effect-transistor is connected to the second node.

The Applicant has appreciated that it is advantageous the drive the reference monitoring circuit portion with the current produced by the output current mirror circuit portion and thus in some preferred embodiments, the reference monitoring circuit portion comprises a reference mirror field-effect-transistor arranged such that: a drain terminal thereof is connected to a source terminal of the replica field-effect-transistor; and respective gate terminals thereof are connected to the gate and drain terminals of the first output current mirror field-effect-transistor.

In order to drive the first and second reference transistors at different current densities, the amount of current flowing through and/or the widths of the first and second transistors must be different. Conveniently the bandgap circuit portion is arranged such that the amount of current through each of the first and second transistors is the same and therefore in a set of embodiments the first and second reference transistors have different widths. In at least some embodiments, a fixed resistor is connected in series with at least the larger one of the first and second reference transistors. This provides compensation for the greater voltage drop across the larger transistor. In some such embodiments, a temperature linearisation resistor is connected in parallel with the series arrangement of the fixed resistor and the larger one of the first and second reference transistors. This may allow the circuit portion to provide reference currents which are relatively stable with temperature whereas convention bandgap circuits provide currents that are proportional to absolute temperature.

The output impedance associated with FET-based current sources can often be lower than might be desirable. Accordingly, in some embodiments the reference voltage circuit comprises a cascode circuit arranged to vary an effective output impedance of the output current mirror circuit portion. In some such embodiments, the cascode circuit portion comprises:

- a first cascode transistor in series with the operational transconductance amplifier;
- a second cascode transistor in series with the first reference transistor;
- a third cascode transistor in series with the second reference transistor;
- a fourth cascode transistor in series with the load; and
- a fifth cascode transistor in series with the reference monitoring circuit;

wherein a control signal is applied to the gate terminals of said first, second, third, fourth, and fifth cascode transistors. In some embodiments, two or more of the first, second, third, fourth, and fifth cascode transistors are substantially matched to one another. In preferred embodiments, all of the first, second, third, fourth, and fifth cascode transistors are substantially matched to one another.

Figure 2:
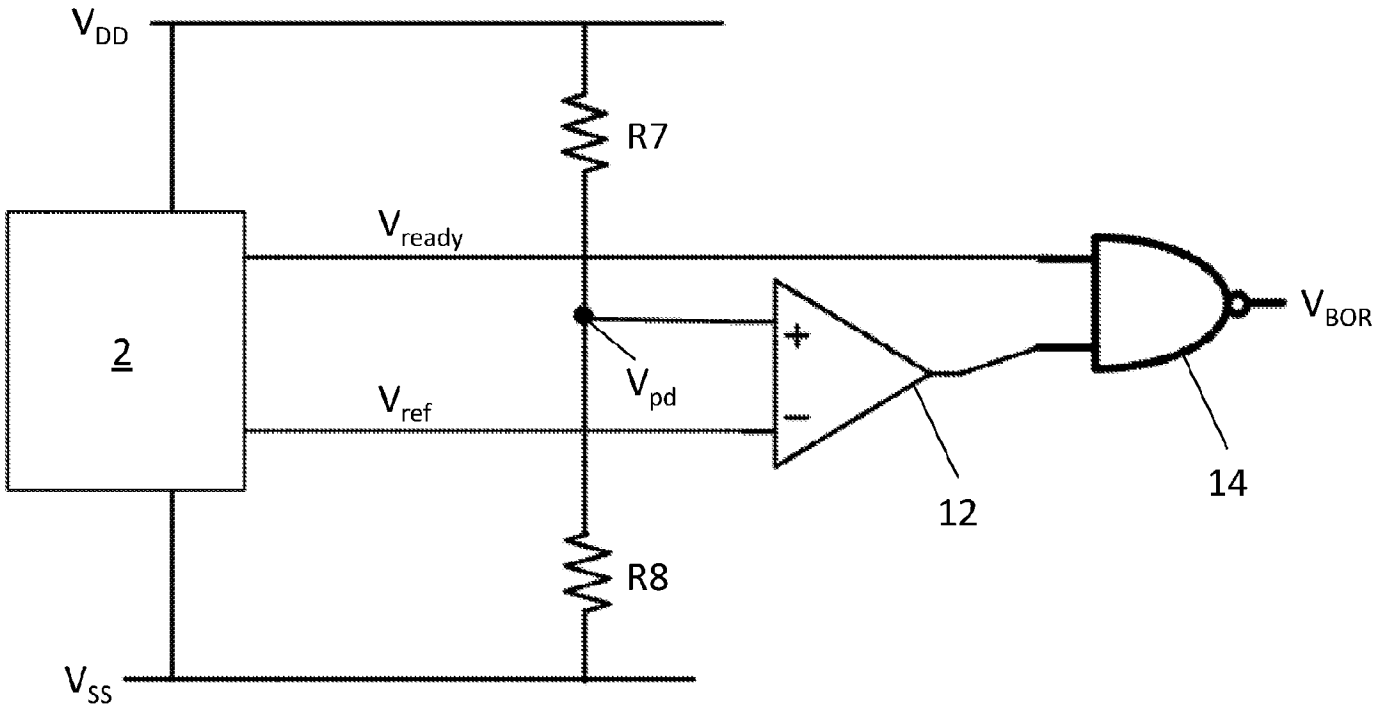

An embodiment of the invention will now be described, by way of example only, with reference to the accompanying drawings in which:

FIG. 1 is a circuit diagram of a reference voltage circuit in accordance with an embodiment of the present invention; and FIG. 2 is a circuit diagram of a brown-out reset circuit that uses the reference voltage circuit of FIG. 1.

FIG. 1 is a circuit diagram of a reference voltage circuit 2 in accordance with an embodiment of the present invention. While it will be appreciated that the reference voltage circuit 2 shown in FIG. 1 would typically be implemented as a single device, it is shown divided into two logical circuit blocks—a bandgap reference circuit 4 and a reference monitoring circuit 6—for ease of reference. The bandgap reference circuit 4 is arranged to provide a fixed reference voltage $V_{ref}$ that does not vary with temperature. The reference monitoring circuit 6 is arranged to monitor the bandgap reference circuit 4 and produce an output signal or "flag" $V_{ready}$ that indicates whether or not the bandgap reference circuit 4 is fully initialised.

The bandgap reference circuit 4 utilises two diode-connected bipolar junction transistors (BJTs) Q1, Q2 as reference transistors which are arranged in parallel. These two reference BJTs Q1, Q2 are arranged to be driven at different current densities as will be described in further detail below. The term "diode-connected" as used herein with reference to a BJT should be understood to mean that the base and collector terminals of the BJT are connected to one another. The emitter terminal of the first reference BJT Q1 is connected to a first node N1, while the emitter terminal of the second reference BJT Q2 is connected to a second node N2 via a fixed resistor R1.

The emitter area of the first reference transistor Q1 is greater than that of the second reference transistor Q1. This means that if the emitter current flowing through each transistor Q1, Q2 is the same, the current densities are different.

A further resistor R2 is connected in parallel with the second reference BJT Q2 and the fixed resistor R1 and provides temperature linearisation as explained below.

The bandgap reference circuit 4 further comprises an operational transconductance amplifier (OTA) constructed from a differential pair of p-channel metal-oxide-semiconductor field-effect-transistors (pMOSFETs) M4, M5, wherein the gate terminal of M4 is connected to the second node N2 and the gate terminal of M5 is connected to the first node N1. The respective source terminals of M4 and M5 are connected to the supply voltage $V_{DD}$ via a tail mirror pMOSFET M10 and a cascade pMOSFET M11, the operation of both of which will be described in further detail below. The respective drain terminals of M4 and M5 are connected to a current mirror load which is constructed from two n-channel metal-oxide-semiconductor field-effect-transistors (nMOSFETs) M12, M13, arranged such that the drain terminal of the first current mirror load nMOSFET M13 is connected to the drain terminal of M5 and to the gate terminals of M12 and M13. The drain terminal of the other current mirror load MOSFET M12 is connected to the drain terminal of M4, while the source terminals of both M12 and M13 are connected to the negative supply rail $V_{SS}$. The output of this differential amplifier is applied to the gate terminal of an output nMOSFET M14, which has its source terminal connected to the negative supply rail $V_{SS}$ and its drain terminal connected to the gate and drain terminals of a diode-connected pMOSFET M9.

This diode-connected pMOSFET M9 has its source terminal connected to the positive supply rail $V_{DD}$ and forms a current mirror with a number of other pMOSFETs. Specifically, the gate and drain terminals of M9 are connected to the gate terminals of: the tail mirror pMOSFET M10; two variable pMOSFETs M1 and M2 arranged in series with the first and second reference BJTs Q1 and Q2 respectively; a load mirror pMOSFET M3 which is connected in series with a load resistance R3 as will be described below; and a monitoring mirror pMOSFET M23 situated within the reference monitoring circuit 6. Thus the current that flows through M9 (due to the conductance of the output nMOSFET M14 as dictated by the output of the differential amplifier) will be mirrored (i.e. copied) through M1, M2, M3, M10, and M23. Ideally at least some, and preferably all, of these transistors M1, M2, M3, M10, and M23 are matched to M9 and, by extension, to one another.

The bandgap reference circuit 4 further comprises a cascode circuit portion comprising: a first cascode pMOSFET M11 connected in series with the tail mirror pMOSFET M10 and the differential pair pMOSFETs M4 and M4; a second cascode pMOSFET M15 connected between M1 and Q1; a third cascode pMOSFET M16 connected between M2 and R1; a fourth cascode pMOSFET M17 connected between M3 and R3; and a fifth cascode pMOSFET M22 connected to the monitoring mirror pMOSFET M23. The gate terminals of each of these cascode transistors M11, M15, M16, M17, M22 are connected to a control voltage $V_{cascode}$ that controls the conductivity of the cascode circuit portion and sets the output impedance of the effective current sources (i.e. the tail-based current source provided to the differential pair transistors M4 and M5, the current sources provided to the reference transistors Q1 and Q2 by M1 and M2 respectively, the current source provided to the load R3 by M3, and the current source provided by M23 to the reference monitoring circuit portion 6), to a desired value. Similarly to the current mirror arrangement described above, it is advantageous if some, and preferably all, of these transistors M11, M15, M16, M17, and M22 are matched to one another.

The reference monitoring circuit 6 comprises the monitoring mirror pMOSFET M23 and the monitoring cascode pMOSFET M22 as described previously and further comprises: a replica pMOSFET M6; a replica current mirror constructed from two replica current mirror nMOSFETs M20 and M21; an inverter 8; fixed resistors R5 and R6; and a hysteresis pMOSFET M18. The reference monitoring circuit 6 is arranged such that the source terminal of M23 is connected to the positive supply voltage $V_{DD}$; the source terminal of M22 is connected to the drain terminal of M23; the source terminal of M6 is connected to the drain terminal of M22; and the drain terminal of M20 is connected to the drain terminal of M6. Furthermore, the gate terminals of M20 and M21 are both connected to the respective drain terminals of M6 and M20. The drain terminal of M21 is connected to the input of the inverter 8 at a monitoring node N3 and to R6 which is further connected to the input voltage $V_{DD}$ via R5. R5 is arranged in parallel with the hysteresis pMOSFET M18 such that the source terminal of M18 is connected to $V_{DD}$, the drain terminal of M18 is connected to a node between R5 and R6, and the gate terminal of M18 is connected to the output of the inverter 8.

The inverter 8 is arranged to perform a Boolean NOT operation on a signal provided at its input and provide a digital output signal $V_{ready}$ that is indicative of whether the bandgap reference circuit 4 is ready for use.

The operational transconductance amplifier is arranged to attempt to drive the voltage at the two nodes N1, N2 to the same value. Any difference in the voltages at the two nodes N1, N2 will cause a non-zero output voltage at the drain terminal of M12 which is applied to the gate terminal of M14. This causes M14 to conduct and thus a current flows from $V_{DD}$ to $V_{SS}$ through the diode-connected transistor M9. As the current through M9 is mirrored through M3, a current flows through the reference resistor R3 which gives rise to the reference voltage $V_{ref}$ across R3 in accordance with Ohm's law.

As a result of the current mirrors based on M1 and M2 respectively, the emitter currents through the reference transistors Q1, Q2 are the same. However as Q2 is larger, say N times larger, its base-emitter voltage $V_{BE2}$ will be lower than the base-emitter voltage of Q1, $V_{BE1}$ as shown in Eq. 1:

$$V_{BE2} = V_{BE1} - \frac{kT}{q} \cdot \ln(N) \quad \text{(Eq 1)}$$

where k/q is a constant and T is temperature.

The OTA comprising M4 and M5 ensures that nodes N1 and N2 are at the same voltage. Hence, the voltage across resistor R1 is equal to $V_{BE1}-V_{BE2}$, and the current through this resistor becomes:

$$I_{R1} = \frac{V_{BE1} - V_{BE2}}{R_1} = \frac{kT}{qR_1} \cdot \ln(N) \quad \text{(Eq 2)}$$

The current through resistor R2 can simply be expressed as:

$$I_{R2} = \frac{V_{BE1}}{R_2} \quad \text{(Eq 3)}$$

From this, the current through the pMOS transistor M2 is calculated as:

$$I_{M2} = I_{R2} + I_{R1} = \frac{V_{BE1}}{R_2} + \frac{kT}{qR_1} \cdot \ln(N) \quad \text{(Eq 4)}$$

This is also the current through M3, and hence the output voltage becomes:

$$V_{ref} = R_3 \cdot I_{M3} = \frac{R_3}{R_2} \cdot V_{BE1} + \frac{R_3}{R_1} \cdot \frac{kT}{q} \cdot \ln(N) \quad \text{(Eq 5)}$$

$V_{BE1}$ has a negative temperature coefficient, while kT/q has a positive temperature coefficient. By adjusting the ratio of R1 and R2 it is possible to achieve an overall temperature coefficient that is close to zero within the operating temperature range. The output voltage is then set to the desired level (0.9V) by adjusting R3.

The circuit shown thus provides reference currents that are relatively stable with temperature, whereas conventional bandgap circuits provide currents that are proportional to absolute temperature.

Furthermore, as the current through M9 is also mirrored through M23 (providing M5 is well matched with M6 and M13 is well matched with M20), the same current that flows through the "branch" of the operational transconductance amplifier comprising M10, M11, M5, and M13 will flow through the replica branch in the reference monitoring circuit 6 comprising M23, M22, M6, and M20. Furthermore as M20 forms a current mirror with M21, the current that flows through this replica branch will also flow through M21. Due to the fixed resistor R6 (and in some cases R5), this current provides a voltage at the monitoring node N3 which is connected to the input of the inverter 8.

If the voltage at this monitoring node N3 is sufficiently low, the inverter 8 will produce a logic high (i.e. a digital "one") at its output, and this digital signal is the flag $V_{ready}$ used to indicate whether or not the band gap reference circuit 4 is ready for use by external circuitry. When $V_{ready}$ is logic high, the hysteresis transistor M18 is effectively disabled due to the connection of its gate terminal to the output of the inverter 8. Under such circumstances, the voltage at the monitoring node N3 will be equal to the current flowing through M21 multiplied by the resistance of the series combination of R5 and R6 (any drain-source resistance of M21 is ignored here for simplicity).

If the voltage at the monitoring node N3 exceeds a particular threshold, the inverter 8 will produce a logic low (i.e. a digital "zero") flag $V_{ready}$. Due to the connection of the output of the inverter 8 to the gate terminal of the hysteresis transistor M18, this causes the hysteresis transistor M18 to conduct, effectively "short circuiting" R5. In this case, the voltage at the monitoring node N3 is then equal to the current flowing through M21 multiplied by the resistance of R6 only.

Thus the reference monitoring circuit 6 keeps the flag $V_{ready}$ at logic low until sufficient current flows through the OTA (i.e. through the branch comprising M5, M11, M10, and M13), which is indicative of the bandgap reference circuit 4 being ready for use. As the reference monitoring circuit 6 is "blind" to the headroom requirements of the OTA, sufficient current will only be flowing through the OTA when it is operating as required regardless of headroom requirements, which is an indirect indication that the bandgap reference circuit 4 may be relied on by external circuitry.

FIG. 2 is a circuit diagram of a brown-out reset (BOR) circuit 10 that uses the reference voltage circuit 2 described previously with reference to FIG. 1. The BOR circuit 10 comprises a comparator 12, a two input NAND gate 14, and a potential divider constructed from two fixed resistors R7 and R8 between the supply rails $V_{DD}$, $V_{SS}$. A potential divider voltage $V_{pd}$, which is a fixed fraction of the supply voltage at a node between R7 and R8 is provided at to the non-inverting input of the comparator 12. The reference voltage $V_{ref}$ produced by the band gap reference circuit 4 within the reference voltage circuit 2 of FIG. 1 is provided to the inverting input of the comparator 12. The output of this comparator 12 is connected to one of the inputs of the NAND gate 14, while the other input of the NAND gate 14 is arranged to receive the flag $V_{ready}$ produced by the reference monitoring circuit 6. This NAND gate 14 is arranged to perform a Boolean NAND operation on its two inputs and produce a brown-out reset signal $V_{BOR}$ which is arranged to reset the device in the event of a brown-out.

Under normal operation the flag $V_{ready}$ is high indicating that the reference voltage $V_{ref}$ produced by the reference voltage circuit 2 is reliable. The supply voltage will be sufficiently high that the voltage $V_{pd}$ produced by the potential divider is greater than the reference voltage $V_{ref}$ and so the output of the comparator 12 will also be high. As both inputs to the NAND gate are 14 are high, its output $V_{BOR}$ remains low. In the event of a significant drop in the supply voltage, the voltage $V_{pd}$ produced by the potential divider falls below the reference $V_{ref}$ so the output of the comparator goes low. Because one of the inputs to the NAND gate 14 goes low, the $V_{BOR}$ output is pushed high, triggering a reset. With a further drop in supply voltage the bandgap reference circuit 4 enters a region where it does not have enough supply voltage to generate $V_{ref}$ and so the $V_{ready}$ flag goes low, Since the bandgap reference circuit 4 is no longer providing an adequate reference voltage the voltage at point $V_{pd}$ could become higher than $V_{ref}$, in turn triggering the output of the comparator 12 high. However the brown-out reset signal $V_{BOR}$ remains high because the $V_{ready}$ flag being low keeps the output of the NAND gate 14 low. It can be seen therefore that without this gating of the comparator 12 with the $V_{ready}$ flag the brown-out reset signal $V_{BOR}$, could have been erroneously removed. After restoration of the supply voltage, or in the case of initial switch-on of the device, the output of the comparator 12 goes high because the potential divider voltage $V_{pd}$ is pulled higher than the reference voltage $V_{ref}$, but the brown-out reset signal $V_{BOR}$ will not go low again until the $V_{ready}$ flag also goes high. This ensures that the brown-out reset signal $V_{BOR}$ is not removed until the reference voltage $V_{ref}$ is stable and ready to be used. The $V_{ready}$ flag is tracked to the supply requirement of the bandgap reference circuit 4 and means that the situation whereby the comparator produces a false positive is masked because the reference monitoring circuit 6 has a defined reset state below its threshold.

Thus it will be appreciated by those skilled in the art that the present invention provides a reference voltage circuit having a reference monitoring circuit that provides a flag indicative of the reference voltage circuit being ready for use by external circuitry, wherein the flag has a well-defined logical state regardless of any supply voltage variations. It will be appreciated by those skilled in the art that the embodiments described above are merely exemplary and are not limiting on the scope of the invention.

The invention claimed is:

1. A reference voltage circuit comprising:

a bandgap circuit portion comprising first and second reference transistors and a current source arranged to drive the first reference transistor at a first current density and to drive the second reference transistor at a second, different current density, wherein the first reference transistor is connected to a first node and the second reference transistor is connected to a second node;

an operational transconductance amplifier arranged to produce an output current that is proportional to a difference between a voltage at the first node and a voltage at the second node;

an output current mirror circuit portion arranged to generate a mirror current that is a scaled version of the output current and drive said mirror current through a load so as to produce a reference voltage; and a reference monitoring circuit portion arranged to monitor the operational transconductance amplifier and generate a flag if a current flowing through the operational transconductance amplifier exceeds a threshold.

2. The reference voltage circuit as claimed in claim 1, wherein the operational transconductance amplifier comprises first and second differential pair field-effect-transistors arranged such that a gate terminal of the first differential pair field-effect-transistor is connected to the first node and a gate terminal of the second differential pair field-effect-transistor is connected to the second node.

3. The reference voltage circuit as claimed in claim 2, wherein the operational transconductance amplifier comprises first and second current mirror load field-effect-transistors, arranged such that:

a drain terminal of the first current mirror load field-effect-transistor is connected to a drain terminal of the first differential pair field-effect-transistor;

a drain terminal of the second current mirror load field-effect-transistor is connected to a drain terminal of the second differential pair field-effect-transistor; and respective gate terminals of the first and second current mirror load field-effect-transistors are connected to the drain terminal of the first current mirror load field-effect-transistor.

4. The reference voltage circuit as claimed in claim 2, wherein the operational transconductance amplifier comprises a tail field-effect-transistor arranged such that a drain terminal thereof is connected to respective drain terminals of the first and second differential pair field-effect-transistors.

5. The reference voltage circuit as claimed in claim 4, wherein a gate terminal of the tail field-effect-transistor is connected to the output current mirror circuit portion.

6. The reference voltage circuit as claimed in claim 1, wherein the reference monitoring circuit portion comprises a second current mirror and a replica field-effect-transistor having a gate terminal thereof connected to the first node, wherein the second current mirror is arranged to generate a replica current that is a scaled version of the output current and drive said replica current through a first reference resistor so as to generate a voltage at a monitor node between the second current mirror and the first reference resistor.

7. The reference voltage circuit as claimed in claim 2, wherein the reference monitoring circuit portion comprises a second current mirror and a replica field-effect-transistor having a gate terminal thereof connected to the first node, wherein the second current mirror is arranged to generate a replica current that is a scaled version of the output current and drive said replica current through a first reference resistor so as to generate a voltage at a monitor node between the second current mirror and the first reference resistor.

8. The reference voltage circuit as claimed in claim 7, wherein the replica field-effect transistor is matched to the first differential pair field-effect-transistor.

9. The reference voltage circuit as claimed in claim 6, wherein the second current mirror comprises first and second replica current mirror field-effect-transistors, arranged such that:

respective gate terminals of the first and second replica current mirror field-effect-transistors are connected to a drain terminal of the first replica current mirror field-effect-transistor and to a drain terminal of the replica field-effect-transistor; and a drain terminal of the second replica current mirror field-effect-transistor is connected to the monitor node.

10. The reference voltage circuit as claimed in claim 1, wherein the reference monitoring circuit portion comprises a single-input logic gate having an input terminal thereof connected to the monitor node, wherein the logic gate is arranged to produce a first logic value at an output thereof if the voltage at the monitor node is above a first threshold and to produce a second logic value at the output if the voltage at the monitor node is below a second threshold.

11. The reference voltage circuit as claimed in claim 10, wherein the logic gate comprises a Boolean inverter, the first logic value is logic low and the second logic value is logic high.

12. The reference voltage circuit as claimed in claim 11, comprising a hysteresis arrangement connected between the input and the output of the inverter and is arranged such that the first threshold is different to the second threshold.

13. The reference voltage circuit as claimed in claim 12, wherein the hysteresis arrangement comprises a second reference resistor and a switching arrangement, wherein said switching arrangement may selectively couple the first and second reference resistors.

14. The reference voltage circuit as claimed in claim 13, wherein the switching arrangement comprises a hysteresis transistor connected in parallel to the second reference resistor, wherein a gate terminal of said hysteresis transistor is connected to the output of the inverter.

15. The reference voltage circuit as claimed in claim 10, wherein the logic gate comprises a Schmitt trigger, the first logic value is logic high and the second logic value is logic low.

16. The reference voltage circuit as claimed in claim 1, wherein the output current mirror circuit portion comprises:

an output field-effect-transistor arranged such that a gate terminal thereof is connected to an output of the operational transconductance amplifier;

first and second output current mirror field-effect-transistors, arranged such that:

a drain terminal of the first output current mirror field-effect-transistor is connected to a drain terminal of the output field-effect-transistor;

a drain terminal of the second output current mirror field-effect-transistor is connected to the load; and respective gate terminals of the first and second output current mirror field-effect-transistors are connected to the drain terminal of the first output current mirror field-effect-transistor.

17. The reference voltage circuit as claimed in claim 16, wherein the output current mirror circuit portion further comprises third and fourth output current mirror field-effect-transistors, arranged such that:

respective gate terminals thereof are connected to the gate and drain terminals of the first output current mirror field-effect-transistor;

a drain terminal of the third output current mirror field-effect-transistor is connected to the first node; and a drain terminal of the fourth output current mirror field-effect-transistor is connected to the second node.

18. The reference voltage circuit as claimed in claim 1, wherein the reference monitoring circuit portion comprises a reference mirror field-effect-transistor arranged such that: a drain terminal thereof is connected to a source terminal of the replica field-effect-transistor; and respective gate terminals thereof are connected to the gate and drain terminals of the first output current mirror field-effect-transistor.

19. The reference voltage circuit as claimed in claim 1, wherein the first and second reference transistors have different widths.

20. The reference voltage circuit as claimed in claim 19, comprising a fixed resistor connected in series with at least the larger one of the first and second reference transistors.

21. The reference voltage circuit as claimed in claim 20, comprising a temperature linearisation resistor connected in parallel with the series arrangement of the fixed resistor and the larger one of the first and second reference transistors.

22. The reference voltage circuit as claimed in claim 1, further comprising a cascode circuit arranged to vary an effective output impedance of the output current mirror circuit portion.

23. The reference voltage circuit as claimed in claim 22, wherein the cascode circuit portion comprises:

a first cascode transistor in series with the operational transconductance amplifier;

a second cascode transistor in series with the first reference transistor; a third cascode transistor in series with the second reference transistor; a fourth cascode transistor in series with the load; and a fifth cascode transistor in series with the reference monitoring circuit; wherein a control signal is applied to the gate terminals of said first, second, third, fourth, and fifth cascode transistors.

24. The reference voltage circuit as claimed in claim 23, wherein two or more of the first, second, third, fourth, and fifth cascode transistors are substantially matched to one another.

25. The reference voltage circuit as claimed in claim 24, wherein all of the first, second, third, fourth, and fifth cascode transistors are substantially matched to one another.

* * * * *